US006668433B1

(12) United States Patent
Hood

(10) Patent No.: US 6,668,433 B1
(45) Date of Patent: Dec. 30, 2003

(54) SHIELD FOR QUICK RELEASE FASTENER

(76) Inventor: Darin L. Hood, 3720 W. Villa Maria, Glendale, AZ (US) 85308

( * ) Notice: Subject to any disclaimer, the term of this patent is extended or adjusted under 35 U.S.C. 154(b) by 0 days.

(21) Appl. No.: 10/020,099

(22) Filed: Dec. 14, 2001

Related U.S. Application Data

(60) Provisional application No. 60/255,832, filed on Dec. 15, 2000.

(51) Int. Cl.[7] ..... A44B 11/26; A44B 11/25

(52) U.S. Cl. ..... 24/633; 24/163 R

(58) Field of Search ..... 24/163 R, 625, 24/633, 578.15, DIG. 31, 167, 166, 184, 579.11, 579.09

(56) References Cited

U.S. PATENT DOCUMENTS 4,674,303 A 6/1987 Salcone, II
4,731,912 A 3/1988 Boriskie et al.
4,893,835 A * 1/1990 Linden ..... 280/808
4,961,251 A 10/1990 Smith
5,129,129 A 7/1992 Collins et al.
5,189,767 A 3/1993 Reitsma
5,307,544 A * 5/1994 Quarberg et al. ..... 24/633
5,617,617 A * 4/1997 Gustin ..... 24/633
5,774,956 A 7/1998 French et al.
6,092,265 A * 7/2000 Sesay ..... 24/200
6,463,637 B1 * 10/2002 Carnahan ..... 24/578.15

* cited by examiner

*Primary Examiner*—Robert J. Sandy
(74) *Attorney, Agent, or Firm*—Parsons&Goltry; Robert A. Parsons; Michael W. Goltry

(57) ABSTRACT

A shield for covering and preventing undesirable disengagement of a fastener including a female element having opposing notches, the female element for receiving the outwardly biased prongs of a male element. The shield includes a pair of opposed side rails for receipt about the sides of the fastener, for overlying the notches in the female element. A coupling member holds the opposed side rails in a substantially parallel and spaced apart relationship. Engagement members coupled to the pair of opposed side rails, engage the female element of the fastener.

9 Claims, 1 Drawing Sheet

FIG. 2
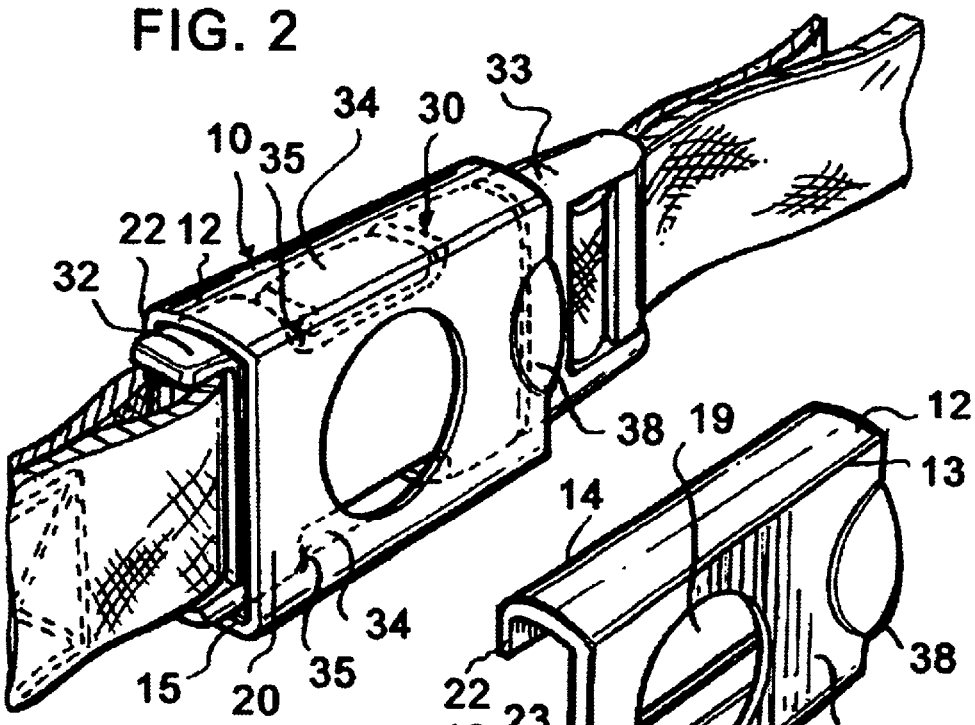
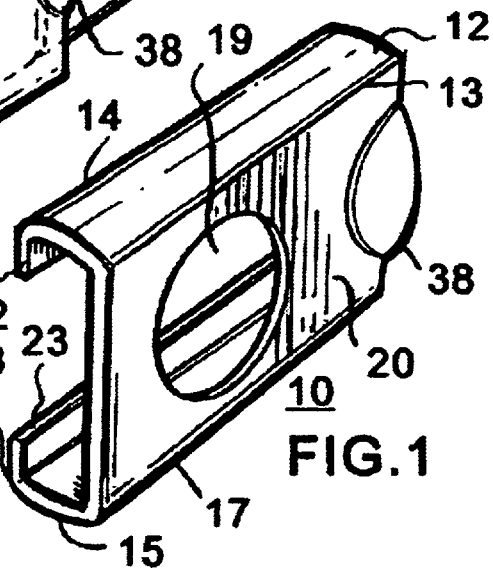
FIG.1
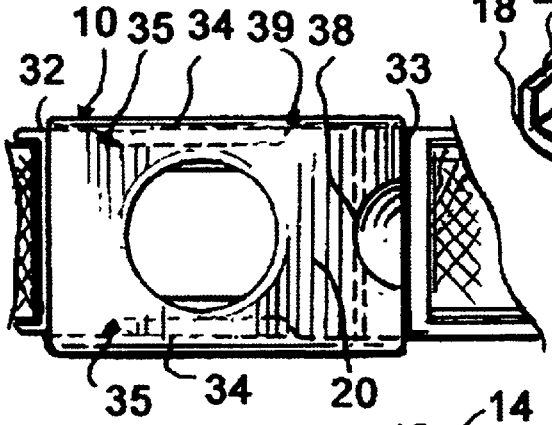
FIG. 3
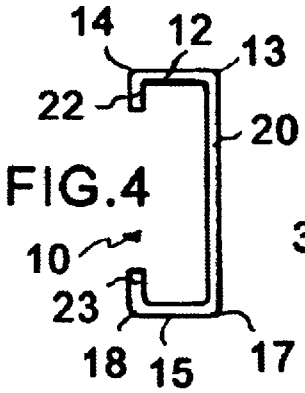
FIG.4
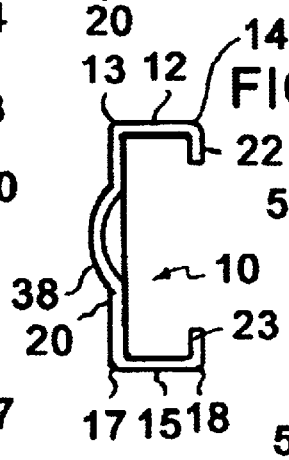
FIG. 5
FIG. 6
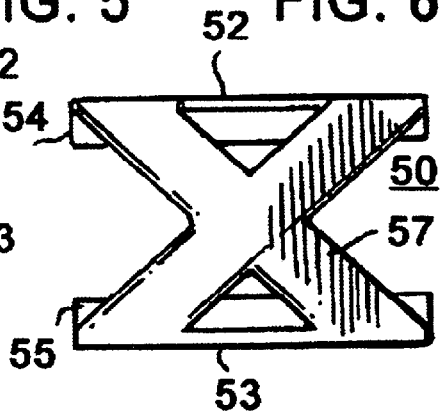

SHIELD FOR QUICK RELEASE FASTENER

CROSS-REFERENCE TO RELATED APPLICATION

This application claims the benefit of U.S. provisional application No. 60/255,832 filed Dec. 15, 2000.

FIELD OF THE INVENTION

This invention relates to fastening devices.

More particularly, the present invention relates to covers for preventing the unintentional release of fastening devices.

BACKGROUND OF THE INVENTION

Quick release fasteners for belts, fanny packs, etc. are well known and are currently used in many products. A conventional fastener includes a female element receiving a male element. The male element is typically divided into outwardly biased prongs which are compressed to be received within the female element and which bias outwardly once inserted, to engage notches in the female element. To separate the elements, the prongs of the male element are compressed against the bias, allowing removal from the female element. Generally, engagement and removal is accomplished with tabs extending from the prongs of the male element. When the elements are engaged, the tabs of the male element are received in notches in the female element, preventing removal of the male element from the female element. By pressing inwardly on the tabs, the prongs are compressed against the bias and the tabs move out of the notches. This permits removal of the male element from the female element.

While these quick release fasteners are extremely effective for their intended purpose, namely being easily and quickly unfastened, there are times when release is undesirable. For example, the utility/gun belt used by police officers is often fastened using a quick release fastener. During the apprehension of a suspect or other situations, a struggle can ensue. A quick release fastener, in this instance, is detrimental as the individual can disarm the police officer simply by gripping the quick release fastener.

It would be highly advantageous, therefore, to remedy the foregoing and other deficiencies inherent in the prior art.

Accordingly, it is an object of the present invention to provide a shield for quick release fasteners.

Another object of the invention is to provide a shield which prevents unintentional disengagement of quick release fasteners.

And another object of the invention is to provide a shield which is inexpensive and simple to use.

Still another object of the present invention is to provide a shield which can be employed on existing fasteners.

SUMMARY OF THE INVENTION

Briefly, to achieve the desired objects of the present invention in accordance with a preferred embodiment thereof, provided is a shield for a fastener. The shield and fastener form a fastening device protected from undesirable disengagement. The fastener includes a female element having opposing notches and a male element having outwardly biased prongs receivable within the female element. Each prong has a tab extending through one of the opposing notches of the female element in a biased orientation. The shield includes a pair of opposed side rails received about the sides of the fastener, overlying the notches in the female element. A coupling member holds the opposed side rails in a substantially parallel and spaced apart relationship, and engagement members coupled to the pair of opposed side rails, engage the female element of the fastener.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 1 is a perspective view of a shield according to the present invention;

FIG. 2 is a perspective view of the shield of FIG. 1 as it appears coupled to a quick release fastener;

FIG. 3 is a top plan view of the shield and fastener of FIG. 2;

FIG. 4 is an end view of the shield of FIG. 1;

FIG. 5 is an opposing end view of the shield of FIG. 1; and

FIG. 6 is a top plan of another embodiment of a shield according to the present invention.

DETAILED DESCRIPTION OF THE PREFERRED EMBODIMENT

Turning now to the drawings in which like reference characters indicate corresponding elements throughout the several views, attention is first directed to FIGS. 1, 4 and 5, which illustrate a shield generally designated 10. Shield 10 includes a side rail 12 being generally rectangular and having opposing edges 13 and 14, and a side rail 15 being generally rectangular and having opposing edges 17 and 18. Side rail 12 and side rail 15 are positioned in a generally parallel spaced apart relationship, and held together by a coupling member 20. In this embodiment, coupling member 20 is a generally planar sheet extending from edge 13 of side rail 12 to edge 17 of side rail 15. Additionally it should be noted that side rails 12 and 15 can have a slight curvature as seen in the FIGS. or remain substantially planar.

Coupling member 20 is illustrated as being generally solid apart from an opening 19 centrally formed therein. One skilled in the art will understand that coupling member 20 can be solid, have an opening for aesthetic purposes or be simply a frame, coupling side rails 12 and 15, and providing a degree of rigidity for purposes which will become apparent as the description progresses. Coupling member 20 provides stability and rigidity to side rails 12 and 15. Engagement members, in this embodiment a lip 22 extending from edge 14 of first side rail 12 and a lip 23 extending from edge 18 of side rail 15, engage a quick release fastener.

With additional reference to FIGS. 2 and 3, in use, shield 10 is positioned over a quick release fastener generally designated 30. Quick release fastener 30 includes a female element 32 receiving a male element 33. Male element 33 is typically divided into outwardly biased prongs (not shown) having tabs 34 extending outwardly therefrom. Female element 32 includes notches 35 formed in opposing sides. The prongs are compressed to be received within female element 32 and allowed to bias outwardly once inserted. When correctly positioned, tabs 34 are received in notches 35 preventing removal of male element 33 from female element 32. To separate the elements, the prongs of male element 33 are compressed against their bias. By pressing inwardly on tabs 34, the prongs are compressed and tabs 34 move out of notches 35, permitting removal of male element 33 from female element 32.

Shield 10 is positioned over quick release fastener 30 when female element 32 and male element 33 are engaged. Shield 10 is positioned with side rails 12 and 15 extending along the sides of fastener 30 overlying and covering notches 35 and tabs 34. Lips, 22 and 23 engage the back of fastener 30 holding shield 10 in position. It should be understood that while lips are shown extending the entire length of side rails, shorter lengths may be employed. It is even contemplated that vestigial lips segments may be provided at opposing ends of the opposing side rails. Coupling member 20 joins and stabilizes side rails 12 and 15 and is fabricated of a slightly flexible material to permit lips 22 and 23 to be pulled apart. Shield 10 is preferably fabricated as an integral piece molded of a plastic material, although other materials can be employed. In this manner, shield 10 can be positioned on fastener 30 by flexing coupling member 20, positioning lips 22 and 23 behind fastener 30 and allowing coupling member 20 to return to its normal position. This action, in effect, clamps shield 10 about fastener 30. Removal is the reverse of this procedure. Removal is facilitated by the inclusion of a thumb tab 38 formed in an end of coupling member 20.

To further facilitate attachment and removal of shield 10 to fastener 30, one of lips 22 and 23 can be shorter than the other. Thus, the longer of lips 22 and 23 is first positioned behind fastener 30 and very little flexing of coupling member 20 is required to position the shorter of lips 22 and 30 behind fastener 30. It is even contemplated that with the shorter lip, flexing of coupling member 20 is unnecessary. The shorter lip itself may distort sufficiently to allow shield 10 to be coupled about fastener 30.

Turning now to FIG. 6, another embodiment of a shield generally designated 50 is illustrated. Shield 50 is generally similar to shield 10, including side rails 52 and 53, lips 54 and 55, and coupling member 57. In this embodiment, coupling member 57 has an X shape and is intended to illustrate that coupling member 57 is intended to provide stability to side rails, hold lips 54 and 55 about a fastener, and can be fabricated of substantially any shape to achieve these ends.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is.

What is claimed is:

1. A shield for covering a fastener and preventing undesirable disengagement thereof comprising:

a pair of opposed side rails for receipt about the sides of a fastener;

a coupling member holding the opposed side rails in a substantially parallel and spaced apart relationship; and engagement members coupled to the pair of opposed side rails for engaging the fastener, the engagement members including a first lip and a second lip extending generally perpendicularly from the opposed side rails; and wherein the first lip is engagable over the fastener and the coupling member is movable between a flexed orientation for permitting the second lip to be fitted over the fastener and a normal orientation wherein the first lip and the second lip engage the fastener.

2. A shield as claimed in claim 1 wherein one of the first lip and the second lip is shorter than the other.

3. A shield as claimed in claim 1 wherein the first lip and the second lip extend substantially the length of the opposed side rails.

4. A shield for covering and preventing undesirable disengagement of a fastener including a female element having opposing notches, the female element for receiving outwardly biased prongs of a male element, the shield comprising:

a pair of opposed side rails for receipt about the sides of a fastener, for overlying the notches in the female element;

a coupling member holding the opposed side rails in a substantially parallel and spaced apart relationship; and engagement members coupled to the pair of opposed side rails for engaging the female element of the fastener, the engagement members including a first lip and a second lip extending generally perpendicularly from the opposed side rails; and wherein the first lip is engagable over the fastener and the coupling member is movable between a flexed orientation for permitting the second lip to be fitted over the fastener and a normal orientation wherein the first lip and the second lip engage the fastener.

5. A shield as claimed in claim 4 wherein one of the first lip and the second lip is shorter than the other.

6. A shield as claimed in claim 4 wherein the first lip and the second lip extend substantially the length of the opposed side rails.

7. A fastening device protected from undesirable disengagement, comprising:

a female element having opposing notches;

a male element having outwardly biased prongs receivable within the female element, each prong having a tab extending through one of the opposing notches of the female element in a biased orientation; and a shield comprising:

a pair of opposed side rails received about the sides of the female element, overlying the notches in the female element;

a coupling member holding the opposed side rails in a substantially parallel and spaced apart relationship; and engagement members coupled to the pair of opposed side rails engaging the female element, the engagement members including a first lip and a second lip extending generally perpendicularly from the opposed side rails; and wherein the first lip is engaged over the fastener and the coupling member is movable between a flexed orientation for permitting the second lip to be fitted over the fastener and a normal orientation wherein the first lip and the second lip engage the fastener.

8. A shield as claimed in claim 7 wherein one of the first lip and the second lip is shorter than the other.

9. A shield as claimed in claim 7 wherein the first lip and the second lip extend substantially the length of the opposed side rails.

* * * * *